US011587774B2

(12) United States Patent
McAlister

(10) Patent No.: US 11,587,774 B2
(45) Date of Patent: Feb. 21, 2023

(54) USING REAL TIME SEARCH RESULTS TO DYNAMICALLY EXCLUDE PRODUCT IONS THAT MAY BE PRESENT IN THE MASTER SCAN

(71) Applicant: Thermo Finnigan LLC, San Jose, CA (US)

(72) Inventor: Graeme C. McAlister, San Jose, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 17/027,021

(22) Filed: Sep. 21, 2020

(65) Prior Publication Data

US 2022/0093378 A1 Mar. 24, 2022

(51) Int. Cl.
*H01J 49/00* (2006.01)

(52) U.S. Cl.
CPC ..... *H01J 49/0036* (2013.01); *H01J 49/0031* (2013.01); *H01J 49/0045* (2013.01)

(58) Field of Classification Search
CPC . H01J 49/0036; H01J 49/0031; H01J 49/0045
USPC ..... 250/282
See application file for complete search history.

(56) References Cited

U.S. PATENT DOCUMENTS 7,351,956 B2 * 4/2008 Le Blanc ..... G01N 30/8641 250/281
7,485,852 B2 2/2009 Yamashita et al.
7,498,568 B2 3/2009 Overney et al.
7,511,267 B2 3/2009 Zabrouskov
7,586,089 B2 * 9/2009 Hartmer ..... H01J 49/42 250/281
9,230,785 B2 * 1/2016 Murase ..... H01J 49/42
9,390,896 B2 7/2016 Brown et al.
9,891,194 B2 * 2/2018 Mann ..... G01N 33/483
9,911,585 B1 * 3/2018 Zabrouskov ..... H01J 49/0031
10,008,376 B2 6/2018 Bloomfield et al.
10,153,146 B2 * 12/2018 Kwiecien ..... H01J 49/0036
10,573,501 B2 * 2/2020 Geromanos ..... H01J 49/0036
10,984,996 B2 * 4/2021 Wang ..... H01J 49/0036
10,989,698 B2 4/2021 Xuan
11,011,359 B2 * 5/2021 Geromanos ..... G01N 33/6854
11,127,581 B2 * 9/2021 Cooks ..... H01J 49/428
(Continued)

OTHER PUBLICATIONS

Graumann et al., "A Framework for Intelligent Data Acquisitionand Real-Time Database Searching for Shotgun Proteomics", Molecular & Cellular Proteomics 11.3: 10.1074/mcp.M111.013185, 1-11, 2012.
(Continued)

*Primary Examiner* — Wyatt A Stoffa

(57) ABSTRACT

A method includes obtaining a first mass spectrum; selecting a first peak of the first mass spectrum; fragmenting and analyzing ions of the first peak to obtain a second mass spectrum; performing a real-time spectral search for compounds corresponding to peaks in the second mass spectrum; identifying fragments for the compounds identified based on the real-time spectral search; adding mass-to-charge ratios for the fragments to an exclusion list; selecting a second peak present in the first mass spectrum and not on the exclusion list; and fragmenting and analyzing ions of the second peak to obtain a third mass spectrum.

17 Claims, 6 Drawing Sheets

(56) References Cited

U.S. PATENT DOCUMENTS

| | | | | |
|---|---|---|---|---|
| 11,169,128 | B2 * | 11/2021 | Pang | G01N 30/7206 |
| 2006/0243900 | A1 | 11/2006 | Overney et al. | |
| 2013/0297226 | A1 * | 11/2013 | Wang | H01J 49/004 702/23 |
| 2016/0268112 | A1 | 9/2016 | Yip et al. | |
| 2020/0266042 | A1 * | 8/2020 | Geromanos | G01N 30/72 |

OTHER PUBLICATIONS

Medzihradszky et al., "The Characteristics of Peptide Collision-Induced Dissociation Using a High-Performance MALDI-TOF/TOF Tandem Mass Spectrometer", Anal. Chem. 2000, 72, pp. 552-558.

Wandy et al., "In Silico Optimization of Mass SpectrometryFragmentation Strategies in Metabolomics", Metabolites 2019, 9, 219, 16 pages.

Gillet, et al., "Targeted Data Extraction of the MS/MS Spectra Generated by Data-independent Acquisition: A New Concept for Consistent and Accurate Proteome Analysis", Molecular & Cellular Proteomics 11.6, 2012, pp. 1-17.

* cited by examiner

USING REAL TIME SEARCH RESULTS TO DYNAMICALLY EXCLUDE PRODUCT IONS THAT MAY BE PRESENT IN THE MASTER SCAN

FIELD

The present disclosure generally relates to the field of ion chromatography including using real time search results to dynamically exclude product ions that may be present in the master scan.

INTRODUCTION

Mass spectrometers are often coupled with chromatography systems in order to identify and characterize eluting species from a test sample. In such a coupled system, the eluent is ionized, and a series of mass spectral scans are obtained for subsequent data analysis. As the test sample may contain many species or compounds, it is often desirable to be able to automatically determine or identify species or compounds of interest as they elute and to use those identifications to inform subsequent tandem mass spectra collection.

Tandem mass spectrometry, referred to as MSn, is a popular and widely used analytical technique whereby precursor ions derived from a sample are subjected to fragmentation under controlled conditions to produce product ions. Tandem mass spectrometry is a mode of operation that utilizes multiple stages of mass analysis with a collision or reaction process between each stage of mass analysis. Often this collision or reaction process is preceded by an ion selection step where one or more ions is isolated from the other precursor ions of the parent ion generation. The coupling of multiple stages of mass analysis provides the ability to determine or identify species or compounds of interest by providing additional information on the fragmentation or reaction characteristics of the compound. The product ion spectra contain information that is useful for structural elucidation and for identification of sample components with high specificity. Tandem mass spectrometry having two stages of mass analysis is typically referred to as MS/MS or MS2.

In data dependent mode, the eluting sample is automatically analyzed by the mass spectrometer. A parent scan is first collected. Often this parent scan is simply an MS1 scan of all the species present in the ionized eluent. Using various algorithms and criteria, the mass spectrometer identifies ions in the parent scan for subsequent analysis by MS2. In some data dependent mass spectrometer methods, the instrument may then identify product ions in the MS2 scan for further analysis by higher order MSn scans. The criteria used for precursor ion identification can be as simple as an intensity threshold or a charge state requirement. Or it may involve more complex filtering such as a dynamic exclusion list where ions previously selected for MSn analysis are excluded form additional MSn analysis for a user defined period of time.

In a typical MS2 experiment, the number of precursors that can be analyzed is limited by the chromatographic peak width and the time it takes the mass spectrometer to collect MS2 scans. From the foregoing it will be appreciated that a need exists for minimizing redundancies in the data collected during a data dependent MS2 analysis.

SUMMARY

In a first aspect, a method can include obtaining a first mass spectrum; selecting a first peak of the first mass spectrum; fragmenting and analyzing ions of the first peak to obtain a second mass spectrum; performing a real-time spectral search for compounds corresponding to peaks in the second mass spectrum; identifying fragments for the compounds identified based on the real-time spectral search; adding mass-to-charge ratios for the fragments to an exclusion list; selecting a second peak present in the first mass spectrum and not on the exclusion list; and fragmenting and analyzing ions of the second peak to obtain a third mass spectrum.

In various embodiments of the first aspect, the mass-to-charge ratio added to the exclusion list can be based on the theoretical mass-to-charge ratio for the fragments of the compound identified.

In various embodiments of the first aspect, the mass-to-charge ratio added to the exclusion list can be based on the theoretical mass-to-charge ratio for the fragments of the compound identified and the mass accuracy or resolution of a mass analyzer used to collect the first mass spectrum. In particular embodiments, the first mass spectrum can be at a different mass accuracy or resolution than the second mass spectrum. In further embodiments, the first mass spectrum can be at a higher mass accuracy or resolution than the second mass spectrum. In further embodiments, performing a real-time spectral search can be based on a mass accuracy or resolution of the second mass spectrum and adding mass-to-charge ratios for the fragments to the exclusion list can be based on a mass accuracy or resolution of the first mass spectrum.

In various embodiments of the first aspect, adding mass-to-charge ratios for the fragments to an exclusion list can include peaks found in the second mass spectrum.

In various embodiments of the first aspect, adding mass-to-charge ratios for the fragments to an exclusion list can include theoretical fragments identified by the real-time spectral search. In particular embodiments, adding mass-to-charge ratios for the fragments to an exclusion list can include theoretical fragments identified by the real-time spectral search and not present in the second mass spectrum.

In particular embodiments, wherein performing a real-time spectral search can be based on a high fragmentation energy of the second mass spectrum and the fragments added to the exclusion list can be based on a low fragmentation energy of the compound identified in the second mass spectrum.

In various embodiments of the first aspect, wherein the fragment ions in the second mass spectrum can be generated by UVPD, ETD, ECD, or another fragmenting process that does not utilize collisions with neutral gas molecules. In particular embodiments, performing a real-time spectral search can be based on expected fragment ion patterns of a fragmentation process used in the second mass spectrum and the fragments added to the exclusion list can be based on standard neutral collision based fragmentation of the compound identified in the second mass spectrum.

In a second aspect, a mass spectrometer can include an ion source, a first mass analyzer, and a controller. The ion source can be configured to ionize a sample to produce ions. The first mass analyzer can be configured to produce a mass spectrum. The controller can be configured to obtain a first mass spectrum using the mass analyzer; select a first peak of the first mass spectrum; fragment and analyze ions of the first peak to obtain a second mass spectrum using the mass analyzer; perform a real-time spectral search for compounds corresponding to peaks in the second mass spectrum; identify fragments for the compounds identified based on the real-time search; add mass-to-charge ratios for the fragments to an exclusion list; select a second peak from the first mass spectrum and not on the exclusion list; and fragment and analyze ions of the second peak to obtain a third mass spectrum using the mass analyzer.

In various embodiments of the second aspect, adding mass-to-charge ratios for the fragments to an exclusion list can include peaks found in the second mass spectrum.

In various embodiments of the second aspect, adding mass-to-charge ratios for the fragments to an exclusion list can include theoretical fragments of the compound identified by the real-time search.

In various embodiments of the second aspect, the real-time spectral search can be based on a high fragmentation energy of the second mass spectrum and the fragments added to the exclusion list can be identified based on a low fragmentation energy of the compound identified in the second mass spectrum.

In various embodiments of the second aspect, the fragment ions in the second mass spectrum can be generated by UVPD, ETD, ECD, or another fragmenting process that does not utilize collisions with neutral gas molecules. In particular embodiments, performing a real-time spectral search can be based on expected fragment ion patterns of a fragmentation process used in the second mass spectrum and the fragments added to the exclusion list can be based on standard neutral collision based fragmentation of the compound identified in the second mass spectrum.

In various embodiments of the second aspect, wherein the first mass spectrum is at a different mass accuracy or resolution than the second mass spectrum.

In various embodiments of the second aspect, wherein the first mass spectrum is at a higher mass accuracy or resolution than the second mass spectrum. In particular embodiments, the real-time spectral search can be based on a mass accuracy or resolution of the second mass spectrum and the mass-to-charge ratios added to the exclusion list can be based on a mass accuracy or resolution of the first mass spectrum.

In a third aspect, a mass spectrometer can include an ion source, a first mass analyzer, a second mass analyzer, and a controller. The ion source can be configured to ionize a sample to produce ions. The first mass analyzer can be configured to produce a first mass spectrum at a first mass accuracy or resolution. The second mass analyzer can be configured to produce a second mass spectrum at a second mass accuracy or resolution. The controller can be configured to obtain a first mass spectrum using the first mass analyzer; select a first peak of the first mass spectrum; fragment and analyze ions of the first peak to obtain a second mass spectrum using the second mass analyzer; perform a real-time spectral search for compounds corresponding to peaks in the second mass spectrum; identify fragments for the compounds identified based on the real-time spectral search; add mass-to-charge ratios for the fragments to an exclusion list; select a second peak from the first mass spectrum and not on the exclusion list; and fragment and analyze ions of the second peak to obtain a third mass spectrum using the second mass analyzer.

In various embodiments of the third aspect, the first mass accuracy or resolution can be different than the second mass accuracy or resolution. In particular embodiments, the first mass accuracy or resolution can be higher than the second mass accuracy or resolution.

In various embodiments of the third aspect, adding mass-to-charge ratios for the fragments to an exclusion list can include peaks found in the second mass spectrum.

In various embodiments of the third aspect, adding mass-to-charge ratios for the fragments to an exclusion list can include theoretical fragments found based upon the compound identified in the real-time search.

In various embodiments of the third aspect, the real-time spectral search can be based on a high fragmentation energy of the second mass spectrum and the fragments added to the exclusion list can be based on a low fragmentation energy of the compound identified by the real-time search.

In various embodiments of the third aspect, the fragment ions in the second mass spectrum can be generated by UVPD, ETD, ECD, or another fragmenting process that does not utilize collisions with neutral gas molecules. In particular embodiments, performing a real-time spectral search can be based on expected fragment ion patterns of a fragmentation process used in the second mass spectrum and the fragments added to the exclusion list can be based on standard neutral collision based fragmentation of the compound identified in the second mass spectrum.

In various embodiments of the third aspect, the real-time spectral search can be based on the second mass accuracy or resolution and adding mass-to-charge ratios for the fragments to the exclusion list can be based on the first mass accuracy or resolution.

DRAWINGS

For a more complete understanding of the principles disclosed herein, and the advantages thereof, reference is now made to the following descriptions taken in conjunction with the accompanying drawings, in which.

Figure 1:
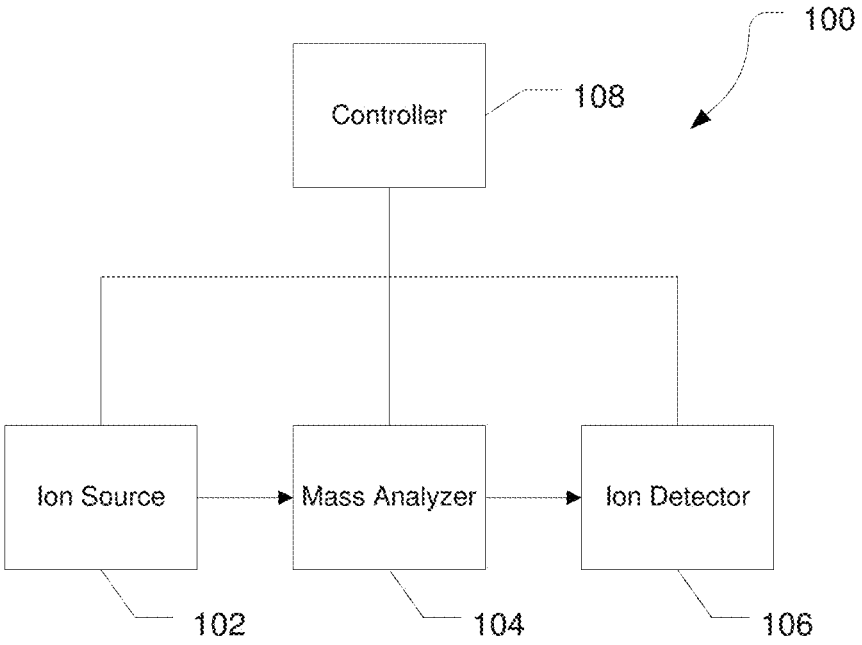
FIG. 1 is a block diagram of an exemplary mass spectrometry system, in accordance with various embodiments.

It is to be understood that the figures are not necessarily drawn to scale, nor are the objects in the figures necessarily drawn to scale in relationship to one another. The figures are depictions that are intended to bring clarity and understanding to various embodiments of apparatuses, systems, and methods disclosed herein. Wherever possible, the same reference numbers will be used throughout the drawings to refer to the same or like parts. Moreover, it should be appreciated that the drawings are not intended to limit the scope of the present teachings in any way.

DESCRIPTION OF VARIOUS EMBODIMENTS

Embodiments of systems and methods to dynamically exclude product ions that may be present in the master scan are described herein.

The section headings used herein are for organizational purposes only and are not to be construed as limiting the described subject matter in any way.

In this detailed description of the various embodiments, for purposes of explanation, numerous specific details are set forth to provide a thorough understanding of the embodiments disclosed. One skilled in the art will appreciate, however, that these various embodiments may be practiced with or without these specific details. In other instances, structures and devices are shown in block diagram form. Furthermore, one skilled in the art can readily appreciate that the specific sequences in which methods are presented and performed are illustrative and it is contemplated that the sequences can be varied and still remain within the spirit and scope of the various embodiments disclosed herein.

All literature and similar materials cited in this application, including but not limited to, patents, patent applications, articles, books, treatises, and internet web pages are expressly incorporated by reference in their entirety for any purpose. Unless described otherwise, all technical and scientific terms used herein have a meaning as is commonly understood by one of ordinary skill in the art to which the various embodiments described herein belongs.

It will be appreciated that there is an implied "about" prior to the temperatures, concentrations, times, pressures, flow rates, cross-sectional areas, etc. discussed in the present teachings, such that slight and insubstantial deviations are within the scope of the present teachings. In this application, the use of the singular includes the plural unless specifically stated otherwise. Also, the use of "comprise", "comprises", "comprising", "contain", "contains", "containing", "include", "includes", and "including" are not intended to be limiting. It is to be understood that both the foregoing general description and the following detailed description are exemplary and explanatory only and are not restrictive of the present teachings.

As used herein, "a" or "an" also may refer to "at least one" or "one or more." Also, the use of "or" is inclusive, such that the phrase "A or B" is true when "A" is true, "B" is true, or both "A" and "B" are true. Further, unless otherwise required by context, singular terms shall include pluralities and plural terms shall include the singular.

A "system" sets forth a set of components, real or abstract, comprising a whole where each component interacts with or is related to at least one other component within the whole.

Mass Spectrometry Platforms

Various embodiments of mass spectrometry platform 100 can include components as displayed in the block diagram of FIG. 1. In various embodiments, elements of FIG. 1 can be incorporated into mass spectrometry platform 100. According to various embodiments, mass spectrometer 100 can include an ion source 102, a mass analyzer 104, an ion detector 106, and a controller 108.

In various embodiments, the ion source 102 generates a plurality of ions from a sample. The ion source can include, but is not limited to, a matrix assisted laser desorption/ionization (MALDI) source, electrospray ionization (ESI) source, atmospheric pressure chemical ionization (APCI) source, atmospheric pressure photoionization source (APPI), inductively coupled plasma (ICP) source, electron ionization source, chemical ionization source, photoionization source, glow discharge ionization source, thermospray ionization source, and the like.

In various embodiments, the mass analyzer 104 can separate ions based on a mass-to-charge ratio (m/z) of the ions. For example, the mass analyzer 104 can include a quadrupole mass filter analyzer, a quadrupole ion trap analyzer, a time-of-flight (TOF) analyzer, an electrostatic trap mass analyzer (e.g., ORBITRAP mass analyzer), Fourier transform ion cyclotron resonance (FT-ICR) mass analyzer, and the like. In various embodiments, the mass analyzer 104 can also be configured to fragment the ions using collision induced dissociation (CID) electron transfer dissociation (ETD), electron capture dissociation (ECD), photo induced dissociation (PID), surface induced dissociation (SID), and the like, and further separate the fragmented ions based on the mass-to-charge ratio.

In various embodiments, the mass spectrometry platform 100 can include multiple mass analyzers. In this way, mass analysis can be performed on two sets of ions at the same time. Additionally, the mass analyzers may have different mass accuracies and/or resolutions, such as a high-resolution electrostatic trap mass analyzer and a lower resolution quadrupole mass analyzer or ion trap mass analyzer.

In various embodiments, the ion detector 106 can detect ions. For example, the ion detector 106 can include an electron multiplier, a Faraday cup, and the like. Ions leaving the mass analyzer can be detected by the ion detector. In various embodiments, the ion detector can be quantitative, such that an accurate count of the ions can be determined.

In various embodiments, the controller 108 can communicate with the ion source 102, the mass analyzer 104, and the ion detector 106. For example, the controller 108 can configure the ion source 102 or enable/disable the ion source 102. Additionally, the controller 108 can configure the mass analyzer 104 to select a particular mass range to detect. Further, the controller 108 can adjust the sensitivity of the ion detector 106, such as by adjusting the gain. Additionally, the controller 106 can adjust the polarity of the ion detector 106 based on the polarity of the ions being detected. For example, the ion detector 106 can be configured to detect positive ions or be configured to detected negative ions.

Data Dependent Analysis

Figure 2:
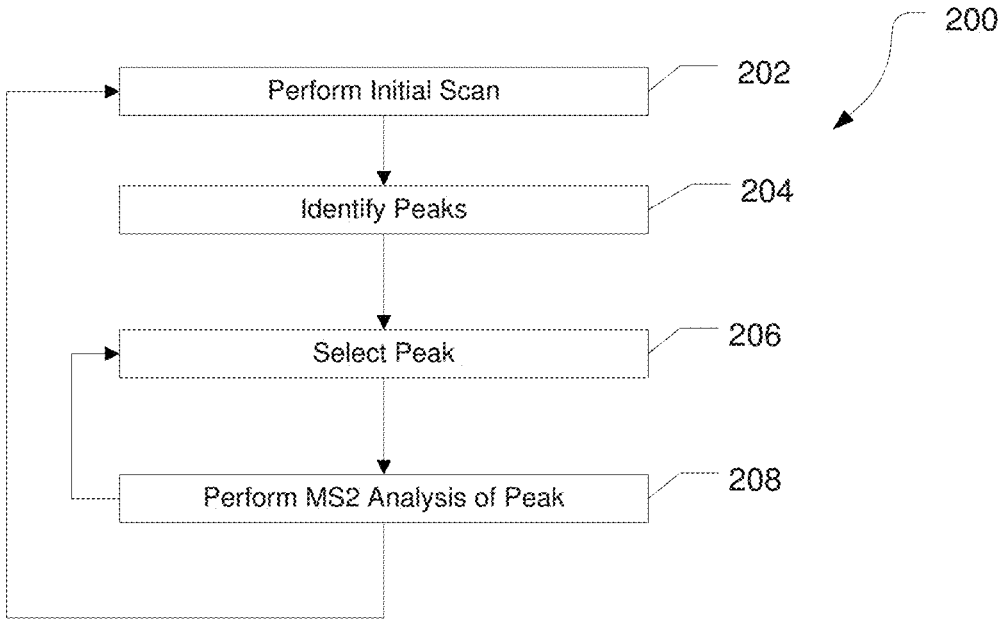
FIG. 2 is a flow diagram illustrating a method data dependent analysis, in accordance with various embodiments.

FIG. 2 is a flow diagram illustrating a method of data dependent analysis 200. At 202, a survey scan can be performed. The survey scan can be used to identified precursor ions present in the ionized eluent for further analysis. Generally, the precursor scan can be performed without intentional fragmentation, such as by utilizing low trapping energy that is below the threshold needed to cause significant fragmentation. Even while attempting to avoid fragmentation, some degree of fragmentation may be inevitable because a minimal amount of trapping energy is needed for efficient ion transfer. Also, low levels of fragmentation can occur elsewhere in the instrument, such as in the ion source. In some instances, certain ions may be particularly prone to fragmentation.

At 204, peaks can be identified in the survey scan spectra (MS1 spectra). Various techniques are known in the art to identify peaks from a mass spectrum. Typically, some approximation of the center of the peak is used to identify the mass-to-charge ratio of an ion.

At 206, a peak can be selected for analysis. In various embodiments, a precursor ion with the highest abundance can be selected. In other embodiments, precursors may be selected at least in part based on an inclusion list. The inclusion list can include mass-to-charge ratios or m/z ranges of particular interest, and when ions are detected within those ranges, they can be selected for MS2 analysis. In further embodiments, an exclusion list can be used to avoid listed precursor ions, such as a precursor ion that was previously analyzed. Many other criteria have been employed to select ions for analysis. Often these criteria are combined together to compromise a list of rules. These additional criteria include but aren't limited too: charge state, monoisotopic m/z assignment, isotope ratio, and mass difference.

At 208, the MS2 analysis can be performed on the selected peak. In the first stage, the precursor ion can be selected based on the mass-to-charge ratio identified from the survey scan. The selected ion can be fragmented to produce product ions and then the mass-to-charge ratios of the product ions can be measured.

After the product ions are measured, another peak can be selected for analysis at 206. Additionally, an additional survey scan at 202 can be performed periodically as the ions and their identities can change throughout a chromatographic run.

Data-dependent methods can be slowed down when they trigger MS2 spectra on product ions present in the MS1 parent scans. These product ions in the master scan can be formed during a variety of different MS events (ionization, transfer, trapping). During a typical data-dependent method the mass spectrometer will trigger MS2 spectra on these product ions if they meet all the standard method filters (e.g., the product ion is abundant enough in the MS1 scan to satisfy an intensity filter). However, in most cases the mass spectrometer method would produce more informative data if the instrument selected a new precursor ion for fragmentation.

Figure 3A:
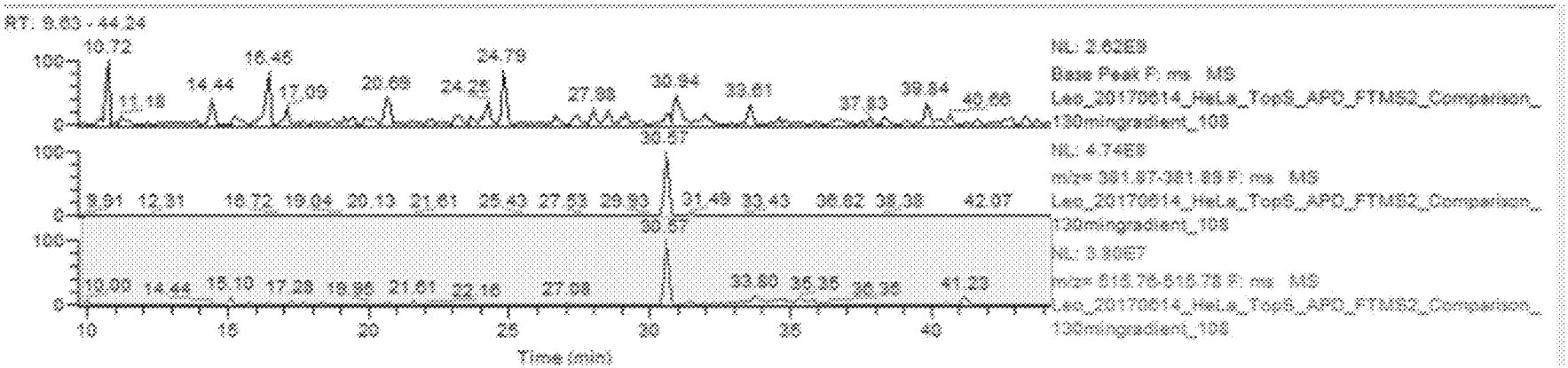
FIG. 3A is a base peak chromatogram and two selected ion chromatograms for the peptide ion IGAEVYHNLK and the y9-fragment of that peptide.

FIGS. 3A, 3B, 3C, and 3D illustrate an example of this phenomenon. In this case a complex HeLa digest is analyzed using a 130-minute LC-MS2 method. The data dependent MS2 method uses the standard set of filters (charge state, dynamic exclusion, monoisotopic m/z assignment, etc.). During the LC-MS2 analysis there is a moderately intense peptide (IGAEVYHNLK) eluting at a retention time of ~30.5 minutes and ionizing at 381.88 m/z. FIG. 3A is a chromatogram illustrating the presence of this peptide at about 30.57 minutes, showing both the XIC of the parent ion at 381.88 m/z and a product ion at 515.77 m/z. While the mass of the product ion is smaller than the parent ion, the mass-to-charge ratio (m/z) is larger due to loss of a charge on the product ion.

Figure 3B:
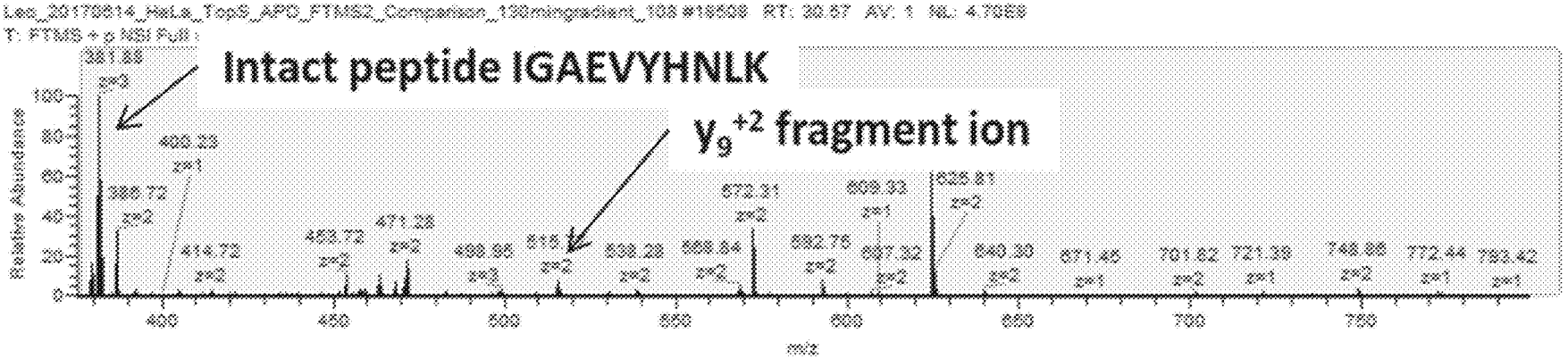
FIGS. 3B, 3C, 3D are mass spectra of the Full MS scan, and the MS2 spectra illustrating data dependent analysis of the peptide ion IGAEVYHNLK and the y9-fragment of that peptide.
Figure 3C:
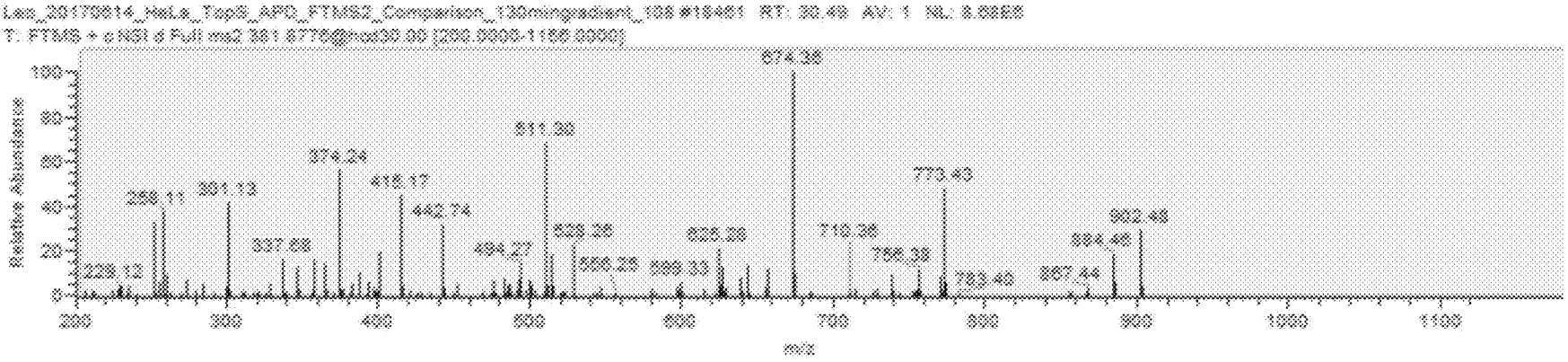
Figure 3D:
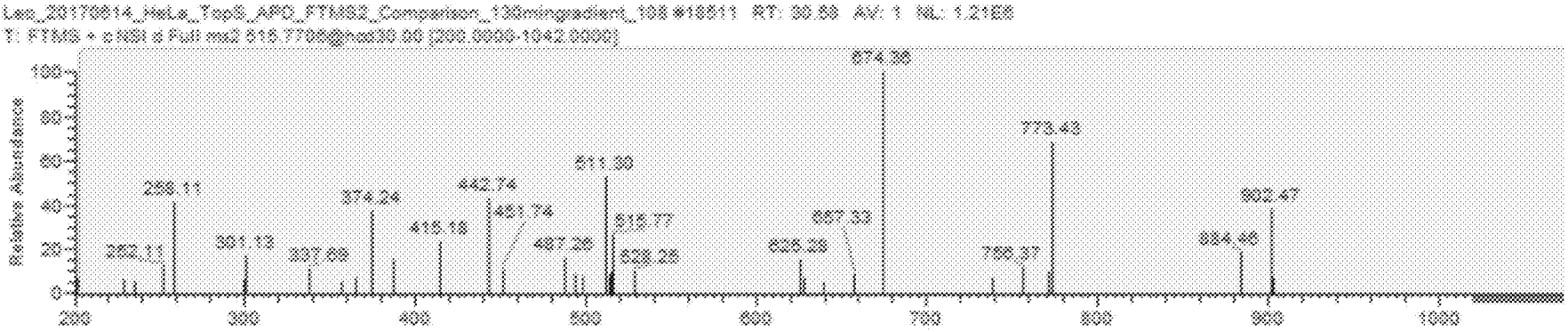

FIG. 3B shows the survey scan illustrating the presence of the peptide at 381.88 m/z. The $y_9^{+2}$ fragment ion is also present in the survey scan at 515.77 m/z. Under conditions where the $y_9^{+2}$ fragment ion meets the selection criteria for the data dependent analysis, both the peptide and the fragment ion can be selected for MS2 analysis. FIG. 3C shows the MS2 spectrum of the parent ion and FIG. 3D shows the MS2 spectrum of the $y_9^{+2}$ fragment ion. It is apparent from a comparison of the MS2 spectra of the precursor peptide and the $y_9^{+2}$ fragment ion that both MS2 spectra are derived from the same parent peptide. Both spectra have nearly identical sets of lower m/z y-type ions ($y_2$ at 374.23 m/z, $y_3$ at 511.30 m/z, and $y_4$ at 674.36 m/z).

The $y_9^{+2}$ fragment ion MS2 spectrum does not provide any additional information that was not already obtained during the fragmentation of the intact parent ion. This can have a greater effect than just a "wasted scan". The product ion MS2 spectrum hurts the overall analysis in two ways. First, by selecting this product ion for MS2 analysis, an opportunity could be missed to go after another MS1 peak that may have been more informative. Second, a database search may not be configured to handle identification of these product ion MS2 scans. As a result, there may not be a chance of producing a true positive peptide spectral match. Ultimately, the inclusion of these product ion MS2 scans in the analysis can skew the calculated false detection rate confidence threshold for the overall dataset, which in turn may result in other good search results being discarded.

Using real time spectral search results for data-dependent exclusion of product ions that may appear in the master scan can avoid performing MS2 scans of fragments of precursor ions that have already been analyzed. In the context of the example presented above, real time searching can involve matching the experimentally observed MS2 spectra against a database or using an algorithm using de novo analysis to identify the precursor ion. In various embodiments, the search can be performed using an algorithm such as Comet (see *Comet: an open source tandem mass spectrometry sequence database search tool*. Eng J K, Japan T A, Hoopmann M R. Proteomics. 2012 Nov. 12) or other algorithms known in the art.

In various embodiments, the theoretical m/z values of matched product ions can be placed on a dynamic exclusion list. In another embodiment, all the theoretical peptide fragment m/z values from the identified peptide sequence can be placed on the exclusion list.

Utilizing the real time search results in this manner can provide a couple of advantages. On hybrid instruments having multiple mass analyzers of different mass accuracy and/or resolution, the mass analyzer used for the MSn product spectra often isn't the same mass analyzer used for the MS1 scans. For example, MS2 product scans can be performed with an ion trap while precursor scans can be performed with an ORBITRAP mass analyzer. As such, simply placing the most intense observed MS2 product ions on the MS1 exclusion list could be problematic. For example, MS2 product ions may have been measured with a mass accuracy of +/−0.5 Th and unit resolution in an ion trap while the MS1 scan can be measured with a mass accuracy of <3 ppm and resolution of >60 k in the ORBITRAP mass analyzer. The use of wide exclusion windows based on the product ion data quality during the precursor spectral processing could potentially prevent the fragmentation of additional informative precursor ions which may be resolved by the higher resolution analyzer.

The real time search can also infer the presence of other MS2 product ions based upon the results of the real time compound identification. FIG. 3B shows a moderately intense $y_9^{+2}$ fragment ion in the MS1 scan, yet the same ion is barely present in the MS2 spectrum in FIG. 3C. Most likely during the MS2 fragmentation this large multiply charged product ion is fragmented multiple times and broken down into smaller y-type fragment ions at higher fragmentation energies used for the MS2 spectrum. Under the far gentler conditions of MS1 trapping, the $y_9^{+2}$ fragment ion is formed and retained at moderate intensity. Simply excluding the most intense ions in the MS2 parent scan could have missed excluding $y_9^{+2}$ fragment ion. The MS2 real time search results, both the intense observed product ions as well as other theoretical product ions that may not be present in the MS2 spectrum but could potentially show up in the MS1 scan can be excluded.

Figure 4:
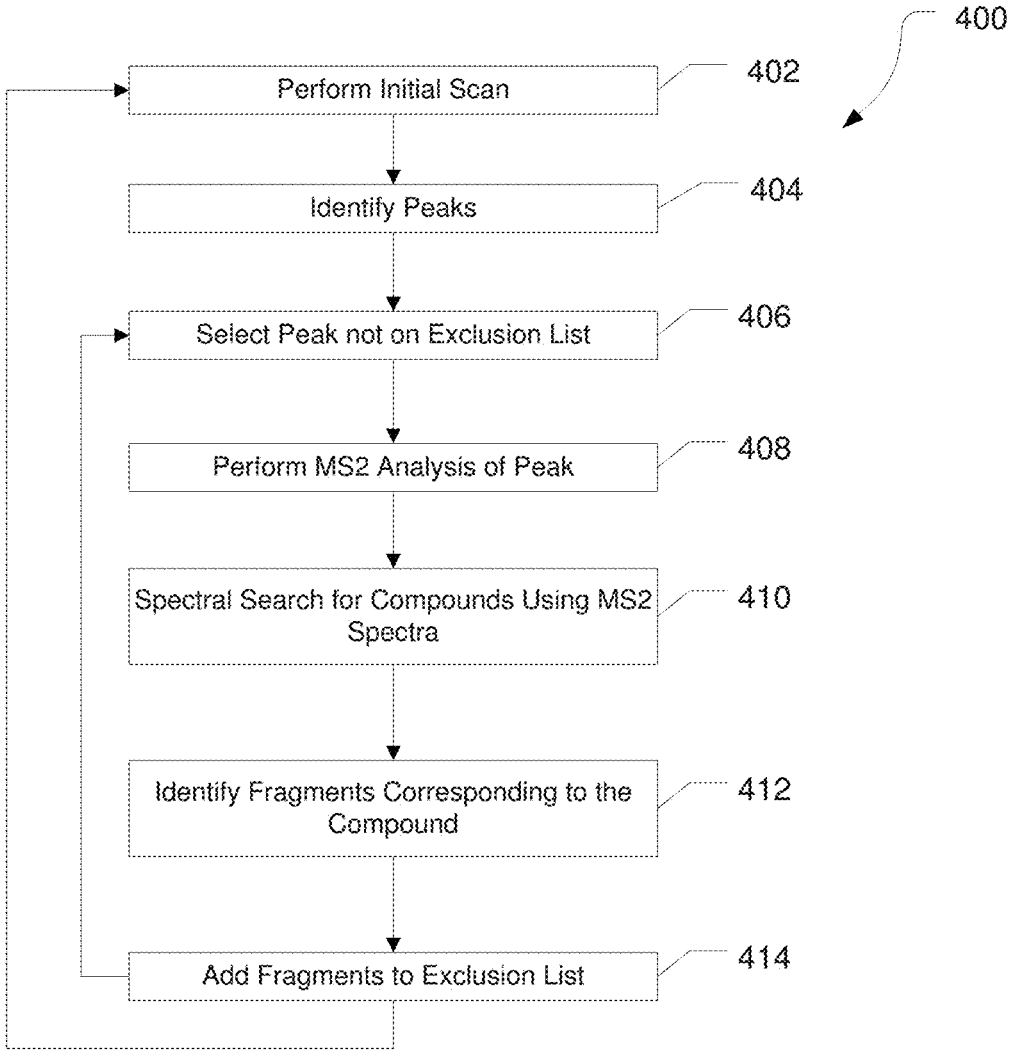
FIG. 4 is a flow diagram illustrating a method data dependent analysis using real time search results to inform peak selection, in accordance with various embodiments.

FIG. 4 is a flow diagram illustrating a method of data dependent analysis 400 utilizing real-time spectral search results. At 402, a survey scan can be performed. The survey scan can be used to identified precursor ions for further analysis. Generally, the precursor scan can be performed without intentional fragmentation, such as by setting a fragmentation cell to a low fragmentation energy below the threshold needed to cause significant fragmentation or by selecting trapping conditions to minimize fragmentation.

At 404, peaks can be identified in the survey scan. Various techniques are known in the art to identify peaks from a mass spectrum. Typically, some approximation of the center of the peak is used to identify the mass-to-charge ratio of an ion.

At 406, a peak can be selected for analysis. In various embodiments, a precursor ion with the highest abundance can be selected. In other embodiments, precursors may be selected at least in part based on an inclusion list. The inclusion list can include mass-to-charge ratios or m/z ranges of particular interest, and when ions are detected within those ranges, they can be selected for MS2 analysis. In further embodiments, an exclusion list can be used to avoid listed precursor ions, such as a precursor ion that was previously analyzed or fragments thereof. Many other criteria have been employed to select ions for analysis. Often these criteria are combined together to compromise a list of rules. These additional criteria include but aren't limited too: charge state, monoisotopic m/z assignment, isotope ratio, and mass difference.

At 408, the MS2 analysis can be performed on the selected peak. In the first stage, the precursor ion can be selected based on the mass-to-charge ratio identified from the survey scan. The selected ion can be fragmented to produce product ions and then the mass-to-charge ratios of the product ions can be identified.

At 410, a spectral analysis can be performed to identify the compound based on the fragment ions in the MS2 spectra. In various embodiments, this spectral analysis may compromise a database search or use of an algorithm to identify compounds based on the fragmentation pattern observed in the MS2 spectra. At 412, the fragments associated with the compound can be identified. In various embodiments, the fragments can include fragments in the MS2 spectra. Additionally, the fragments can include theoretical fragments that are not present in the MS2 spectra but may be theoretically possible based upon the precursor identification. In various embodiments, fragments produced under the conditions of the MS1 scan that may not be detected under the conditions of the MS2 scan can be identified. Additionally, the theoretical exact mass of the fragments can be assigned to the observed fragment ions.

At 414, the identified fragments can be added to an exclusion list. In various embodiments, the exclusion list can include the exact mass of the fragment, allowing for a mass range corresponding to the mass accuracy or resolution of the mass analyzer used to collect the initial survey scan. In various embodiments, the exclusion list can be further based on the mass accuracy or resolution of a mass analyzer used to collect the MS1 spectrum, such as by including a mass range determined by the theoretical exact mass and the mass accuracy or resolution of the mass analyzer. In various embodiments, the exclusion list can include peaks found in the MS2 spectra and/or theoretical fragments of the precursor compound identified by the spectral search, including theoretical fragments not found in the MS2 spectra. Another peak can be selected for analysis at 406. Additionally, an additional survey scan at 402 can be performed periodically as the ions and their identities can change throughout a chromatographic run. Additionally, compounds can be removed from the exclusion list periodically, such as based on the expected chromatographic elution time or peak width.

In various embodiments, modern spectral matching algorithms can simulate the MSn fragmentation spectra based upon the predicted peptide sequence and expected fragmentation energy. In this context, an expected product spectrum used for matching can be simulated using the higher energy MS2 fragmentation conditions, but the ions added to the exclusion list can be based on a simulated product spectrum generated using much gentler energetic conditions of the MS1 scan. As an alternative approach, many small molecule libraries contain fragmentation spectra collected over a range of energies. Higher energy fragmentation spectra can be used for matching the MS2 scan and the exclusion list can be based on lower energy fragmentation spectra. Significantly, as seen with the $y_9^{+2}$ fragment, higher energy fragmentation can lead to further fragmentation of multiply charged fragment ions that may be present in the MS1 spectra and identifying those fragments based on the lower energy fragmentation can be important for avoiding collecting redundant data and maximizing the amount of useful data collected.

In other embodiments the "real time search" may not involve a database search at all. Rather the real-time identification of the parent compound may come from an algorithm designed to identify the parent compound (e.g., "de novo analysis").

There are many ion activation and fragmentation approaches that do not rely upon collisions with neutral gas molecules (e.g., ETD, ECD, UVPD). These alternative fragmentation processes often generate product ions that are different from the ions formed by energetic activation (e.g., c- and z-type product ions of peptides vs. b- and y-type). In this context, ions can be identified using an MS2 spectrum formed via a non-collision-with-neutral fragmentation process and expected fragment ion patterns for the non-collision-with-neutral fragmentation process, and then use that identification can be used to predict the product ions formed via collisional fragmentation. For example, identify an ETD MS2 spectrum of a peptide ion using real time search and then exclude the theoretical b- and y-type product ions produced by energetic fragmentation based upon the peptide sequence.

Figure 5:
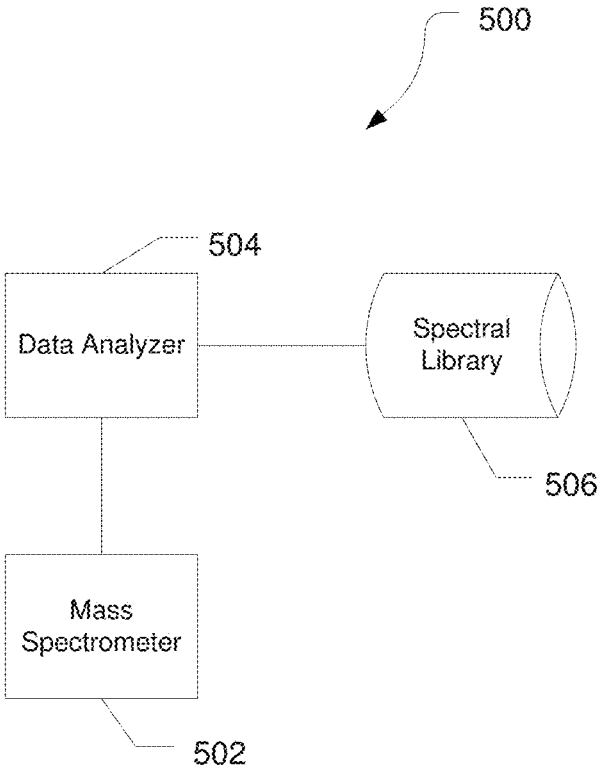
FIG. 5 is a block diagram of an exemplary system for performing data dependent analysis using real time search results to inform peak selection, in accordance with various embodiments.

FIG. 5 illustrates a system 500 for performing data dependent analysis using real-time spectral matching. The system can include a mass spectrometer 502, such as mass spectrometer 100 in FIG. 1, a data analyzer 504, and a spectral library 506. In various embodiments, the data analyzer 504 and the spectral library 506 can reside locally with the mass spectrometer 502, such as on a computer system controlling the mass spectrometer 502. In other embodiments, the data analyzer 504 can reside locally with the mass spectrometer 502 and the spectral library 506 can be cloud based. With a cloud based spectral library 506, it can be advantageous for the data analyzer 504 to locally cache a portion of the spectral library 506. In yet another embodiment, the data analyzer 504 and the spectral library 506 can be cloud based.

Mass spectrometer 502 can provide an MS2 spectrum to data analyzer 504. Data analyzer 504 can perform spectral matching of the MS2 spectra to the spectral library 506 and can identify the compound. Additionally, data analyzer 504 can identify fragment ions of the compound either through simulation or based on the spectral library 506. Data analyzer 504 can provide an exclusion list of fragment ions to the mass spectrometer 502. Mass spectrometer 502 can perform additional analysis based on the exclusion list.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. A method comprising:

obtaining a first mass spectrum;

selecting a first peak of the first mass spectrum;

fragmenting and analyzing ions of the first peak to obtain a second mass spectrum;

performing a real-time spectral search for compounds corresponding to peaks in the second mass spectrum, wherein the real-time spectral search is based on a high fragmentation energy of the second mass spectrum;

identifying fragments for the compounds identified based on the real-time spectral search;

adding mass-to-charge ratios for the fragments of the compounds identified based on the real-time spectral search to an exclusion list, wherein the fragments added to the exclusion list are identified based on a low fragmentation energy spectra of the compounds identified based on the real-time spectral search;

selecting a second peak present in the first mass spectrum and not on the exclusion list; and fragmenting and analyzing ions of the second peak to obtain a third mass spectrum.

2. The method of claim 1, wherein the mass-to-charge ratio added to the exclusion list is based on the theoretical mass-to-charge ratio for the fragments of the compound identified and the mass accuracy or resolution of a mass analyzer used to collect the first mass spectrum.

3. The method of claim 2, wherein the first mass spectrum is at a different mass accuracy or resolution than the second mass spectrum.

4. The method of claim 3, wherein the first mass spectrum is at a higher mass accuracy or resolution than the second mass spectrum.

5. The method of claim 1, wherein adding mass-to-charge ratios for the fragments to the exclusion list includes peaks found in the second mass spectrum.

6. The method of claim 1, wherein adding mass-to-charge ratios for the fragments to the exclusion list includes theoretical fragments identified by the real-time spectral search.

7. The method of claim 6, wherein adding mass-to-charge ratios for the fragments to the exclusion list includes theoretical fragments identified by the real-time spectral search and not present in the second mass spectrum.

8. A mass spectrometer, comprising:

an ion source configured to ionize a sample to produce ions;

a first mass analyzer configured to produce a mass spectrum; and a controller configured to obtain a first mass spectrum using the mass analyzer;

select a first peak of the first mass spectrum;

fragment and analyze ions of the first peak to obtain a second mass spectrum using the mass analyzer;

perform a real-time spectral search for compounds corresponding to peaks in the second mass spectrum, wherein the real-time spectral search is based on a high fragmentation energy of the second mass spectrum;

identify fragments for the compounds identified based on the real-time search;

add mass-to-charge ratios for the fragments of the compounds identified based on the real-time spectral search to an exclusion list, wherein the fragments added to the exclusion list are identified based on a low fragmentation energy spectra of the compounds identified based on the real-time spectral search;

select a second peak from the first mass spectrum and not on the exclusion list; and fragment and analyze ions of the second peak to obtain a third mass spectrum using the mass analyzer.

9. The mass spectrometer of claim 8, wherein adding mass-to-charge ratios for the fragments to the exclusion list includes theoretical fragments of the compound identified by the real-time search.

10. The mass spectrometer of claim 8, wherein the fragment ions in the second mass spectrum are generated by UVPD, ETD, ECD, or another fragmenting process that does not utilize collisions with neutral gas molecules.

11. The mass spectrometer of claim 10, wherein performing a real-time spectral search is based on expected fragment ion patterns of a fragmentation process used in the second mass spectrum and the fragments added to the exclusion list are based on standard neutral collision based fragmentation of the compound identified in the second mass spectrum.

12. The mass spectrometer of claim 8, wherein the first mass spectrum is at a different mass accuracy or resolution than the second mass spectrum.

13. A mass spectrometer, comprising:

an ion source configured to ionize a sample to produce ions;

a first mass analyzer configured to produce a first mass spectrum at a first mass accuracy or resolution;

a second mass analyzer configured to produce a second mass spectrum at a second mass accuracy or resolution; and a controller configured to obtain a first mass spectrum using the first mass analyzer;

select a first peak of the first mass spectrum;

fragment and analyze ions of the first peak to obtain a second mass spectrum using the second mass analyzer;

perform a real-time spectral search for compounds corresponding to peaks in the second mass spectrum;

identify fragments for the compounds identified based on the real-time spectral search;

add mass-to-charge ratios for the fragments of the compounds identified based on the real-time spectral search to an exclusion list;

select a second peak from the first mass spectrum and not on the exclusion list; and fragment and analyze ions of the second peak to obtain a third mass spectrum using the second mass analyzer.

14. The mass spectrometer of claim 13, wherein adding mass-to-charge ratios for the fragments to the exclusion list includes theoretical fragments found based upon the compound identified in the real-time search.

15. The mass spectrometer of claim 13, wherein the real-time spectral search is based on a high fragmentation energy of the second mass spectrum and the fragments added to the exclusion list are based on a low fragmentation energy of the compound identified by the real-time search.

16. The mass spectrometer of claim 13, wherein the fragment ions in the second mass spectrum are generated by UVPD, ETD, ECD, or another fragmenting process that does not utilize collisions with neutral gas molecules.

17. The mass spectrometer of claim 16, wherein performing a real-time spectral search is based on expected fragment ion patterns of a fragmentation process used in the second mass spectrum and the fragments added to the exclusion list are based on standard neutral collision based fragmentation of the compound identified in the second mass spectrum.

* * * * *